US008766070B2

(12) United States Patent
Zumsteg

(10) Patent No.: US 8,766,070 B2
(45) Date of Patent: Jul. 1, 2014

(54) DEVICE FOR ATTACHMENT OF LEVER TO TREMOLO BRIDGE AND KIT

(76) Inventor: Adriano Zumsteg, Sao Paulo-SP (BR)

( * ) Notice: Subject to any disclaimer, the term of this patent is extended or adjusted under 35 U.S.C. 154(b) by 282 days.

(21) Appl. No.: 13/144,798

(22) PCT Filed: Dec. 10, 2009

(86) PCT No.: PCT/BR2009/000422

§ 371 (c)(1),
(2), (4) Date: Jul. 15, 2011

(87) PCT Pub. No.: WO2010/085863

PCT Pub. Date: Aug. 5, 2010

(65) Prior Publication Data

US 2011/0271816 A1 Nov. 10, 2011

(30) Foreign Application Priority Data

Jan. 30, 2009 (BR) ..... 0900201

(51) Int. Cl.
*G10D 3/00* (2006.01)

(52) U.S. Cl.
USPC ..... 84/313

(58) Field of Classification Search
USPC ..... 84/312 R
See application file for complete search history.

(56) References Cited

U.S. PATENT DOCUMENTS 2,781,685 A * 2/1957 White et al. ..... 84/312 R
4,497,236 A * 2/1985 Rose ..... 84/298
4,512,232 A * 4/1985 Schaller ..... 84/313
4,604,936 A 8/1986 Page et al.
4,632,005 A * 12/1986 Steinberger ..... 84/313
4,649,788 A * 3/1987 Matsui ..... 84/297 R
4,655,116 A * 4/1987 Matsui ..... 84/312 R
4,681,011 A 7/1987 Hoshino (Continued)

FOREIGN PATENT DOCUMENTS

BR PI0605431 7/2008
JP 45-16205 7/1970

(Continued)

OTHER PUBLICATIONS

Japanese Notification of Reasons for Refusal mailed on May 31, 2013 for corresponding Japanese Patent Application No. 2011-546540 (4 pages).

*Primary Examiner* — Robert W Horn
(74) *Attorney, Agent, or Firm* — Ostrolenk Faber LLP

(57) ABSTRACT

The present disclosure is a new solution for attachment of lever to the tremolo bridge made by a device that can be sold as a kit. Such device for attachment of lever to the tremolo bridge is made of a cylindrical device (1), of straight base, which has inside it a central channel along its entire vertical axis, and which has teeth (2) through which the lever (3) is attached to the device (1); one solid conical device (4) that has inside it a central channel along its entire vertical axis, and which allows to fit the cylindrical device (1) to the tremolo bridge (5); one or more rings (6) that make the junction between the cylindrical device (1) and the conical device (4); one metal pin (7) with external screw thread and head that crosses the—cylindrical device (1), the conical device (4) and the ring(s) (6) in order to attach them to the tremolo bridge (5); and a system (8) that together with the pin (7) will fix such set of parts to the tremolo bridge (5).

19 Claims, 3 Drawing Sheets

(56) References Cited

U.S. PATENT DOCUMENTS

| | | | | |
|---|---|---|---|---|
| 4,688,461 | A * | 8/1987 | Stroh | 84/298 |
| 5,637,817 | A * | 6/1997 | Sherman | 84/313 |
| 6,201,172 | B1 | 3/2001 | Denton | |
| 6,710,235 | B2 * | 3/2004 | Hirayama | 84/313 |
| 6,875,911 | B2 * | 4/2005 | Schryer | 84/313 |
| 7,247,780 | B2 * | 7/2007 | Sanders et al. | 84/313 |
| 7,718,873 | B1 * | 5/2010 | Slavik | 84/313 |
| 8,314,317 | B2 * | 11/2012 | Hendricks | 84/313 |
| 8,536,431 | B1 * | 9/2013 | Mccabe et al. | 84/313 |
| 2004/0074373 | A1 | 4/2004 | Goto | |
| 2004/0177741 | A1 | 9/2004 | Hirayama | |
| 2011/0271816 | A1 * | 11/2011 | Zumsteg | 84/312 R |
| 2012/0137851 | A1 * | 6/2012 | van Ekstrom | 84/313 |
| 2013/0047816 | A1 * | 2/2013 | Rukavina | 84/313 |

FOREIGN PATENT DOCUMENTS

| | | |
|---|---|---|
| JP | 60-13458 | 1/1985 |
| JP | 7-5874 | 1/1995 |
| JP | 2004-258532 | 9/2004 |
| JP | 2007-268655 | 10/2007 |
| WO | WO 02/073590 | 9/2002 |
| WO | WO 2006/107596 | 10/2006 |
| WO | WO 2008/118557 | 10/2008 |

* cited by examiner

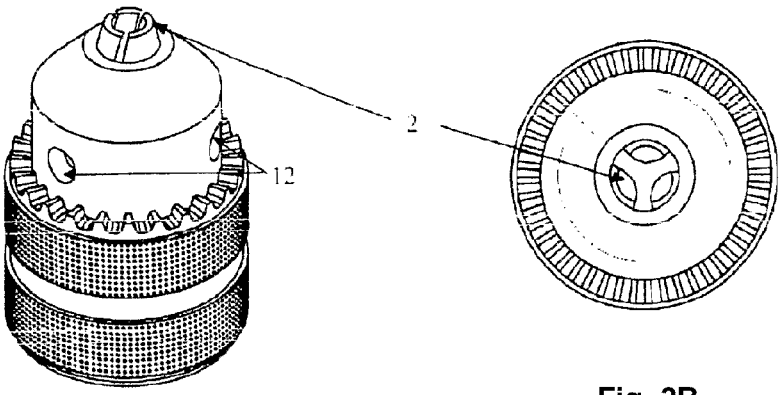
Fig. 2A
Fig. 2B
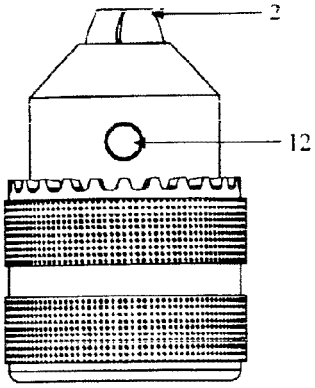
Fig. 2C

DEVICE FOR ATTACHMENT OF LEVER TO TREMOLO BRIDGE AND KIT

CROSS REFERENCE TO RELATED APPLICATIONS

The present application is a 35 U.S.C. §371 National Phase conversion of PCT/BR2009/000422/003327, filed Dec. 10, 2009, which claims benefit of Brazilian Application No. PI0900201-4, filed Jan. 30, 2009, the disclosure of which is incorporated herein by reference. The PCT International Application was published in the English language.

FIELD OF THE DISCLOSURE

This invention is a new solution for attachment of lever to the tremolo bridge made of a device that can be sold as a kit.

RELATED ART

Lever and tremolo bridge are devices for special effects in electric guitars. The role of the tremolo bridge—which is a bridge for fine-tuning the instrument—is to lower or raise the pitch of musical notes in two or more octaves to sharper or graver notes, commanded by said metallic lever.

Currently, there are solutions available in the market such as fixation through threaded connection, where there is an inside screw thread in the bridge body and an external screw thread at the end of the lever. This type of fixation has the disadvantage that the screw thread wears out through use, generating gaps in the lever and impairing its function.

Another type of fixation available is through external nut threaded to an elevation of the lock nut attached to the bridge base. This type generates almost no gap while the part is new, but as the screw threads wear out (of both the base and lever) they generate gaps and it is necessary to use a Teflon tape to secure the lever firmly to its position, since even by applying enough pressure to the screw thread, it breaks loose along time.

Patent application WO2006107596 mentions a lever fixation that mixes both types described above. There is a lock nut elevation attached to the bridge base that has at the same time an internal screw thread. The lever has an external screw thread at the end and a nut; thus, the lever end fits into the internal screw thread of the elevation and then the nut is threaded in the lock nut of same elevation as the bridge base. Patent application WO2008118557 mentions a similar fixation type, where the lever is threaded in a cylindrical chamber of the tremolo bridge and a nut is threaded in lever base to leave it firmer.

On its turn, fixation through pressure uses plastic rings (bearings) in the lever itself; however, the plastic rings wear out through time, generating gaps. In addition, they are difficult to be replaced, because they are not found in the market. Some models add an Allen wrench to the bearings and they often need also a second screw to offset the gap, either by lack of new replacement rings or because the very system is not so accurate as claimed by manufacturers, since it is often also necessary to use a Teflon tape to try to correct the gap that forms. Another problem is that Allen wrenches are too small, and are easily lost, are very frail and the tips of screw threads and of their side-locking hole undergo a natural wear through their handling.

There is also the solid lever with no screw thread, attached only by a side locking with Allen screw and its respective wrench. This solution has problems and disadvantages similar to the previous ones but, even so, to this moment musicians consider it as the most functional system for attaching the lever.

Due to the inconvenient aspects and deficiencies of the solutions pointed out above, the lever becomes a weakness in the performance of the musical instrument. It is often necessary to replace it, causing difficulties to musicians, because there is no adequate replacement for the levers in the market. Certain stores may even sell levers alone, but they hardly obtain them in the same model. Or else, they are sold only as part of the tremolo bridge set, which has the limiting aspects of high price of the set and import difficulties.

PI0605431 already shows a solution for attachment of lever to the tremolo bridge through a device similar to a chuck, but by using a device with fixed threaded axis that forms a single piece that is attached to the tremolo bridge of a special roller bearing. This invention has smaller parts, simpler and cheaper to manufacture, in addition to providing a firm and easily adjustable fixation of the lever, without gaps and with the advantage of the musician having the option of leaving the lever at the position he wishes in relation to the tremolo bridge, that is, "loose" or "fixed", and this displacement is parallel to the guitar body, where such distance does not vary, depending only on the pressure (firmness) exerted on the fixation system.

BRIEF DESCRIPTION OF THE DRAWINGS

The above and other features and advantages of the invention will be further understood from the following detailed description of embodiments thereof, in which:

FIGS. 2A, 2B and 2C are respectively a perspective view, a plan view and a front view of the device.

SUMMARY

Description of the Embodiments

Figure 1:
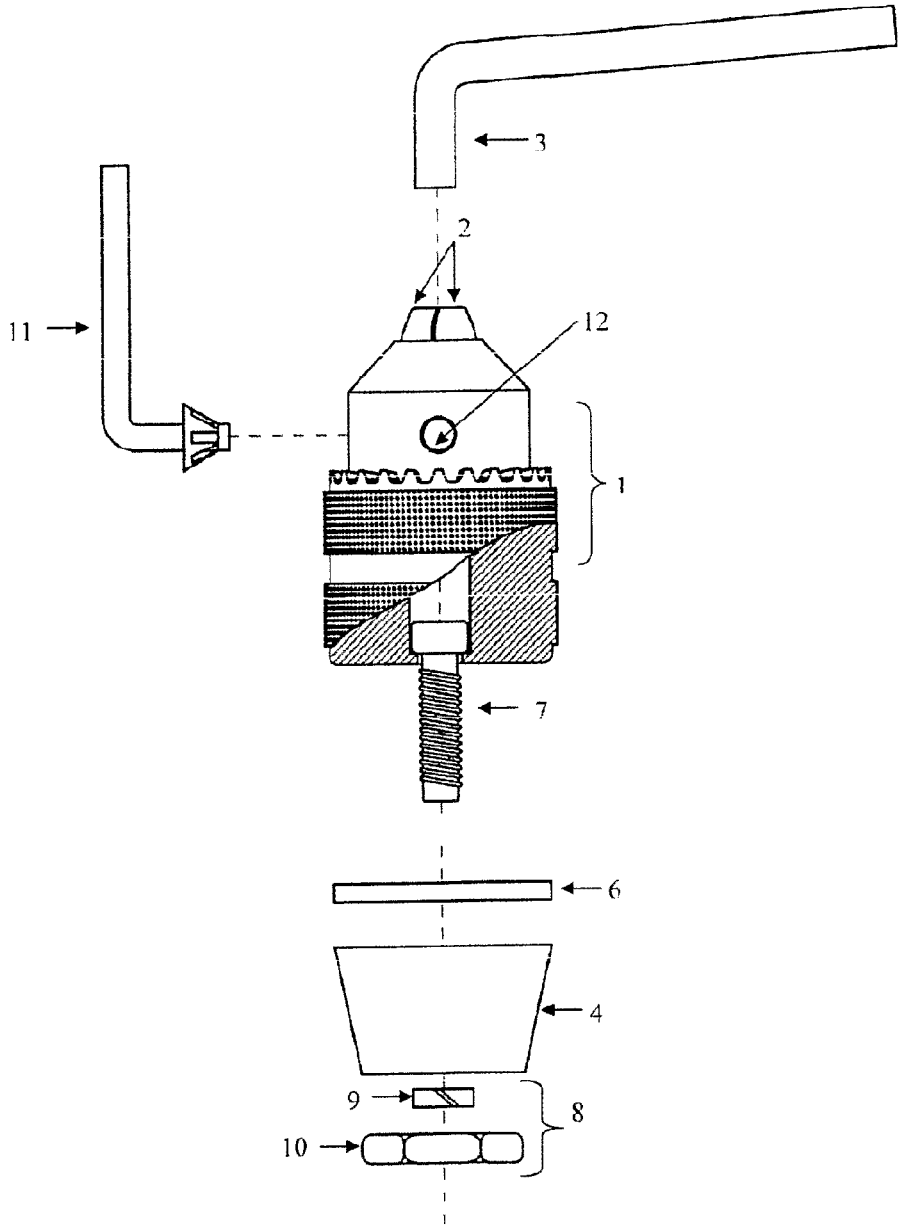
FIG. 1 is an exploded front view of a device for attachment of a lever to a tremolo bridge of a guitar.
Figure 3:
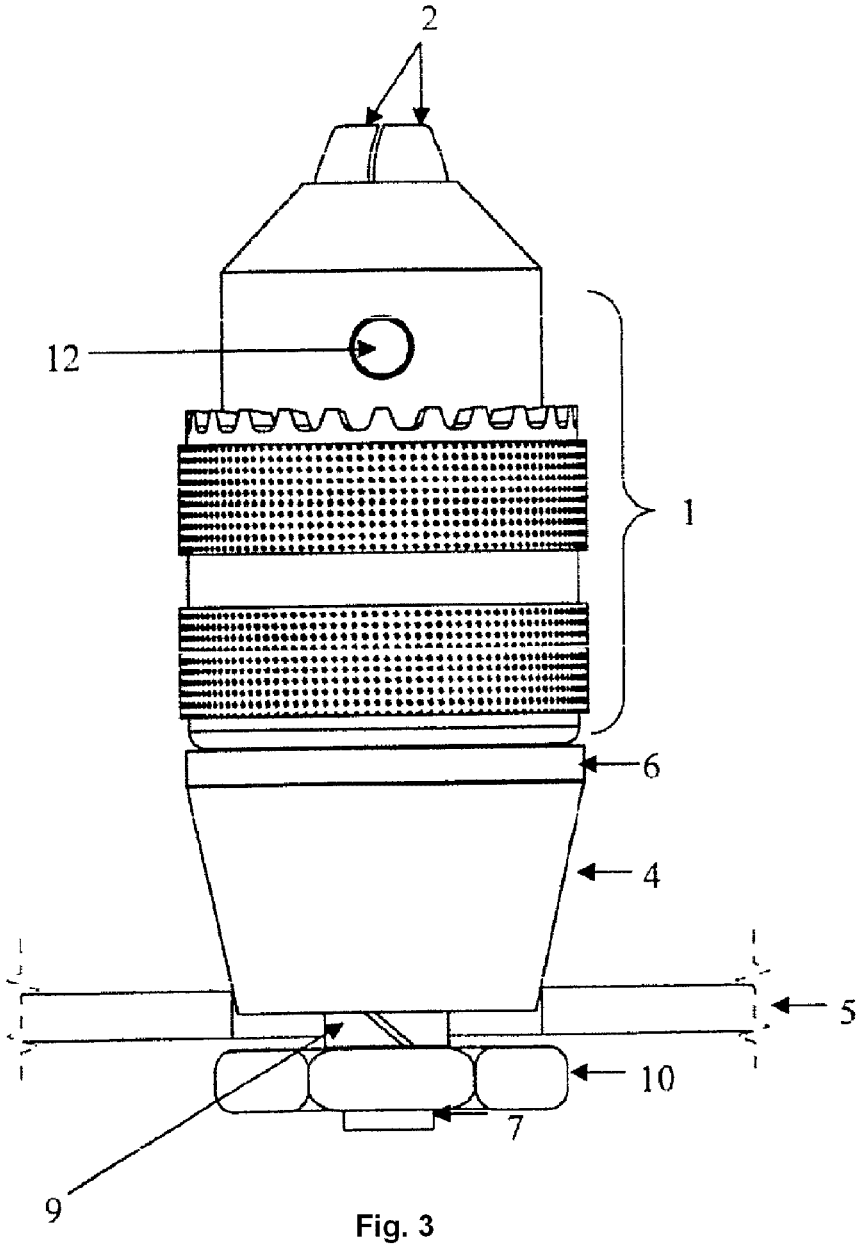
FIG. 3 is a front view showing the device attached to a tremolo bridge.

This invention is a device for attachment of lever to the tremolo bridge, according to FIG. 1, made of a cylindrical device (1), of straight base, best represented by FIGS. 2A, 2B (aerial view) and 2C (front view), which has inside it a central channel along its entire vertical axis, and which has teeth (2) through which the lever (3) is attached to the device (1); one solid conical device (4) that has inside it a central channel along its entire vertical axis, and which allows to fit the cylindrical device (1) to the tremolo bridge (5); one or more rings (6) that make the junction between the cylindrical device (1) and the conical device (4); one pin (7) with external screw thread and head that crosses the cylindrical device (1), the conical device (4) and the ring(s) (6) in order to attach them to the tremolo bridge (5); and a system (8) that together with the pin (7) will fix such set of parts to the tremolo bridge (5). FIG. 3 represents how the device is attached to the tremolo bridge.

The toothed cylindrical device (1) is similar to the chuck used in drilling machines, but it has a straight base that provides a larger contact area and consequently a greater adherence of the device to the tremolo bridge (5). Another difference is that the base hole has a smaller diameter than that of the upper part, making it possible to attach the pin to such device. It can be made of each and every highly-resistant material, pure or combined (alloys of many different materials), such as some types of wood, carbon fibers, Kevlar, varied metals, resins and highly-resistant plastic and acrylic by-products in general; all solid, and preferably made of solid metal. The teeth (2) therein allow a firm fixation of the lever (3), without gaps and without the wear that occurs in case of levers that are attached through threading. In addition, it is possible to use levers both with and without screw threads, because the teeth will secure in the same way.

The conical device (4) can be made of any and all highly-resistant materials, pure or combined (alloys of many different materials) such as: some types of wood, carbon fibers, Kevlar, varied metals, resins and highly-resistant plastic and acrylic by-products in general; all solid, and preferably made of solid metal. The diameter of the upper end is between 10 and 15 mm, being preferably 12 mm, and the diameter of the lower end is between 5 and 7 mm, preferably 6 mm. The upper end of the conical device (4) always follows the diameter of the cylindrical device base (1). The support point through which the lever is attached to the tremolo bridge (5) has varied diameter according to the bridge model and brand. Due to its shape, the conical device (4) adjusts to any support point diameter.

The ring (6), also called washer or joint, has the duty of allowing a pressure to occur between the base of the cylindrical device (1) and the upper part of the conical device (4) when the fixation system of the device (8) below the base of the tremolo bridge (5) is tightened; thus, the lever (3) can be adjusted to the desired position according to the pressure exerted on this system (8). The ring (6) can be made of each and every nonskid material that, once undergoing a certain pressure, is capable of "supporting" and keeping the lever "fixed" (adherence) in the position desired by the musician, such as the following materials; silicone, rubber, cork, foam, latex and rubberized fabrics, being preferably of silicone or rubber.

The pin (7), as well as all other parts that form the total device—with exception of the ring (6) can be made of each and every highly-resistant material, pure and combined (alloys of many different materials), such as: some types of wood, carbon fibers, Kevlar, varied metals, resins and highly-resistant plastic and acrylic by-products in general; all solid, and preferably made of solid metal. The system (8) that, together with the pin (7), will fix the set of parts described previously to the tremolo bridge (5), can be formed by one or more pressure washers (9) and one or more nuts (10).

The pressure washer (9) allows attaching the parts to the base of the tremolo bridge (5) without they breaking loose along time due to the vibration. It can be made of each and any material that is both resistant and malleable, pure or combined, such as: some types of wood, carbon fibers, Kevlar, varied metals, resins and plastic and acrylic byproducts in general; all solid, and preferably made of solid metal. The device for attachment of lever to the tremolo bridge further comprises a tightening wrench (11), preferably "L" shaped, which allows, through the tightening holes (12) adjusting the pressure applied by the teeth (2) of the cylindrical device (1) on the lever (3).

The present device for attachment of lever to the tremolo bridge can be sold as a kit, which comprises all parts of the device plus a lever (3), which may have a straight handle or a fold.

The claimed device for attachment of lever to the tremolo bridge is, thus, an effective solution, of lower cost than those available in the market, with easy replacement of parts.

Below is an example to better illustrate the invention, but it does not have the intent of restricting the invention described here.

Example 1

The threaded metal pin with head (7) is introduced in the cylindrical device (1), of straight base, which has no inner screw. Its head is fixed to the base of the device (1). Between the cylindrical device (1) and the bridge (5), it is necessary to place a ring of nonskid material (6) and a conical device of solid metal (4). The pin (7) is then fixed to the bridge base (5) through a system (8) composed of a pressure washer (9) and a nut (10). The straight handle lever (3) is firmly attached to the cylindrical device (1) by introducing its smaller end between the movable teeth (2) present in the inner upper cavity of the cylindrical device (1). The opening and closing of such teeth are regulated by turning the tightening wrench (11) of the cylindrical device (1) around the tightening holes (12) in conventional manner.

What is claimed is:

1. A device for attachment of a lever to the tremolo bridge of a stringed musical instrument comprising:

a cylindrical device, of straight base, which has inside it a central channel along its entire vertical axis, and which has teeth through which the lever is fixed to the cylindrical device;

a conical device that has inside it a central channel along its entire vertical axis, and which allows to fit the cylindrical device to the tremolo bridge;

one or more rings that make the junction between the cylindrical device and the conical device;

a pin with external screw thread and head that spans the interior cavity of the cylindrical device, the conical device and the ring(s) in order to attach them to the tremolo bridge; and a fixation system affixing the cylindrical device, conical device, one or more rings and pin to the tremolo bridge.

2. The device for attachment of a lever to the tremolo bridge according to claim 1, wherein the base hole of the cylindrical device has a smaller diameter when compared to the hole of the upper part, making it possible to affix the pin to such device.

3. The device for attachment of a lever to the tremolo bridge according to claim 1, wherein the cylindrical device is made of a highly-resistant and solid material selected from the group consisting of wood, carbon fibers, Kevlar, varied metals, resins and highly-resistant plastic and acrylic byproducts.

4. The device for attachment of a lever to the tremolo bridge according to claim 1, wherein the conical device is made of highly-resistant and solid material selected from the group consisting of wood, carbon fibers, Kevlar, varied metals, resins and highly-resistant plastic and acrylic byproducts.

5. The device for attachment of a lever to the tremolo bridge according to claim 4, wherein the conical device has the same diameter as the upper end and is between 10 mm and 15 mm, and the diameter of the lower end is between 5 mm and 7 mm.

6. The device for attachment of a lever to the tremolo bridge according to claim 5, wherein the upper end of the conical device has the same diameter as the cylindrical device base.

7. The device for attachment of a lever to the tremolo bridge according to claim 1, wherein the ring is made of nonskid material that, once undergoing a certain pressure, is capable of interfacing and locking the conical device and the cylindrical device into the position desired by the musician, and is made of a material selected from the group consisting of silicone, rubber, cork, foam, latex and rubberized fabrics.

8. The device for attachment of a lever to the tremolo bridge according to claim 1, wherein the pin is made of highly-resistant and solid material, pure or combined, selected from the group consisting of wood, carbon fibers, Kevlar, varied metals, resins and highly-resistant plastic and acrylic byproducts in general.

9. The device for attachment of a lever to the tremolo bridge according to claim 1, wherein the fixation system of the set is formed by one or more pressure washers and one or more nuts.

10. The device for attachment of a lever to the tremolo bridge according to claim 1, further comprising a tightening wrench, which allows adjusting the pressure applied by the teeth to the lever.

11. The device for attachment of a lever to the tremolo bridge according to claim 8, wherein the tightening wrench is "L" shaped.

12. The device for attachment of a lever to the tremolo bridge according to claim 1, in a kit including the lever.

13. The device for attachment of a lever to the tremolo bridge according to claim 12, wherein the lever has a straight handle.

14. The device for attachment of a lever to the tremolo bridge according to claim 12, wherein the lever has a handle with a curve.

15. The device for attachment of a lever to the tremolo bridge according to claim 1, wherein cylindrical device is made of metal.

16. The device for attachment of a lever to the tremolo bridge according to claim 4, wherein the conical device is made of metal.

17. The device for attachment of a lever to the tremolo bridge according to claim 1, wherein the diameter of the conical device and the upper end is 12 mm.

18. The device for attachment of a lever to the tremolo bridge according to claim 1, wherein the diameter of the lower end is 6 mm.

19. The device for attachment of a lever to the tremolo bridge according to claim 1, wherein the pin is made of metal.

* * * * *